US006375025B1

(12) United States Patent
Mooney

(10) Patent No.: US 6,375,025 B1
(45) **Date of Patent: *Apr. 23, 2002**

(54) HOT-FILLABLE GRIP CONTAINER

(75) Inventor: Michael R. Mooney, Wrightsville, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/466,698

(22) Filed: Dec. 17, 1999

Related U.S. Application Data

(60) Provisional application No. 60/148,872, filed on Aug. 13, 1999.

(51) Int. Cl.[7] ..... B65D 6/38

(52) U.S. Cl. ..... 215/384; 215/381; 220/672; 220/673; 220/771

(58) Field of Search ..... 215/379, 381–384; 220/672, 673, 771

(56) References Cited

U.S. PATENT DOCUMENTS

| | | | | |
|---|---|---|---|---|
| 354,573 | A | * 12/1886 | Norton | 220/673 |
| 3,335,902 | A | * 8/1967 | Javorik | 220/673 |
| D279,167 | S | * 6/1985 | Haney et al. | D9/540 |
| 4,804,097 | A | 2/1989 | Alberghini et al. | |
| 4,890,752 | A | 1/1990 | Ota et al. | |
| 4,946,053 | A | 8/1990 | Conrad | |
| 4,993,565 | A | 2/1991 | Ota et al. | |
| 5,141,120 | A | 8/1992 | Brown et al. | |
| 5,141,121 | A | 8/1992 | Brown et al. | |
| 5,148,930 | A | 9/1992 | Ota et al. | |
| 5,165,557 | A | 11/1992 | Ota et al. | |
| 5,178,290 | A | * 1/1993 | Ota et al. | 215/382 |
| 5,199,587 | A | 4/1993 | Ota et al. | |
| 5,226,550 | A | 7/1993 | Mikolaitis et al. | |
| D344,457 | S | 2/1994 | Prevot et al. | |
| D354,685 | S | 1/1995 | Krishnakumar et al. | |
| 5,392,937 | A | 2/1995 | Prevot et al. | |
| 5,472,105 | A | 12/1995 | Krishnakumar et al. | |
| 5,598,941 | A | 2/1997 | Semersky et al. | |
| D379,763 | S | 6/1997 | Ewing, Jr. | |
| D382,485 | S | 8/1997 | Krishnakumar et al. | |
| D382,807 | S | 8/1997 | Silvers et al. | |
| D385,497 | S | 10/1997 | Krishnakumar et al. | |
| 5,690,244 | A | 11/1997 | Darr | |
| D393,210 | S | 4/1998 | Ewing, Jr. | |
| 5,758,790 | A | 6/1998 | Ewing, Jr. | |
| 5,988,417 | A | 11/1999 | Cheng et al. | |
| D420,593 | S | 2/2000 | Denner et al. | |
| 6,029,837 | A | * 2/2000 | Slat et al. | 215/384 |
| 6,092,688 | A | 7/2000 | Eberle et al. | |

* cited by examiner

*Primary Examiner*—Stephen P. Garbe
*Assistant Examiner*—Joseph C. Merek
(74) *Attorney, Agent, or Firm*—Howson and Howson

(57) ABSTRACT

A hot-fillable container having an opposed pair of collapse panels that move inwardly to accommodate vacuum-induced volumetric shrinkage of the container. The container includes a sidewall having front and rear label panels each of a predetermined radius of curvature and each of a predetermined arcuate extent. A pair of arcuate collapse panels are located between said front and rear label panels, and each has a predetermined arcuate extent and an inset grip region affording facile handling of the container. Desirable structural parameters are disclosed.

35 Claims, 5 Drawing Sheets

HOT-FILLABLE GRIP CONTAINER

This application claims benefit of Provisional application 60/148,872 filed Aug. 13, 1999.

FIELD OF THE INVENTION

The present invention relates to hot-fillable containers, and more particularly, the present invention relates to hot-fillable containers having collapse panels with integral grips.

BACKGROUND OF THE INVENTION

In the early 1990s, Graham Packaging Company pioneered the development of a hot-fillable container that incorporated opposed collapse panels having grip regions that both accommodated the requisite vacuum absorption requirements of hot-fill processing and afforded facile handling of the container by the consumer. The commercialized container is disclosed in U.S. Pat. Nos. 5,392,937; 5,598,941; and U.S. Pat. No. D.344,457.

While Graham's patented container has been a commercial success, there is a need for a grip container having enhanced functional and aesthetic features. There is also a need for a container configuration that can be molded readily. Moreover, container structural modifications that expand the processing window, such as permitting greater fluctuations in fill level, are highly desirable.

In the patented container, the grip region of the collapse panel is relatively narrow, This presents an adequate, but relatively small grip target. A desirable improvement would incorporate a larger grip target, particularly in a horizontal direction, to enable the consumer to have a more secure grip feeling when manipulating the filled container during lifting and pouring.

In the patented container, the front label panel is elongated vertically and has a relatively narrow peripheral extent. An improved container would have greater peripheral extent to afford greater latitude in label design.

High speed labeling equipment requires dimensionally stable container label panels. While the patented container functions well in such equipment, a more robust label panel would assure dimensional stability over a wider range of hot-fill processing conditions and enhance labeling efficiency.

While the patented container is straightforward to produce, it is desirable to provide improved performance with fewer rigid structural elements, as such elements complicate design, impede mold release, and detract from an aesthetically pleasing overall container appearance.

The present invention improves on Graham's patented container and other patented containers, such as those disclosed in U.S. Pat. No. 5,141,120; U.S. Pat. No. 5,141,121; and U.S. Pat. No. 5,472,105, by utilizing a design approach that meets the aforementioned objectives in a novel manner.

OBJECTS OF THE INVENTION

With the foregoing in mind, a primary object of the present invention is to provide a novel grip container for hot-fill applications that is an improvement over the aforementioned patented containers.

Another object of the present invention is to provide an improved grip container for hot fill applications that provides enhanced vacuum absorption capabilities with a minimum of structural elements such as ribs, grooves and the like which detract from production efficiency, as well as the appearance of the container.

A further object of the present invention is to provide a unique grip container for hot-fill applications that has larger front label areas that are structurally robust and afford efficient labeling with high speed equipment.

Still a further object of the present invention is to provide a grip container for hot-fill applications that provides a larger window of hot-fill processing conditions.

SUMMARY OF THE INVENTION

More specifically, the present invention provides a grip container for hot-fill applications that comprises a dome, a base, and a sidewall extending between the dome and the base. The sidewall has diametrically opposed front and rear label panels and opposed collapse panels disposed between the label panels. Each collapse panel has an inset grip region that affords facile gripping of the container by the consumer.

Each of the label panels has a predetermined transverse radius of curvature throughout its arcuate extent, and each of the collapse panels has, throughout its arcuate extent, a predetermined radius of curvature which is larger than the radius of curvature of the label panels. The upper and lower vertical extremities of the collapse panel extend along structural stiffeners, such as a groove below the dome and a label bumper above the base. Each of the collapse panels is bordered by vertical transitional zones located at the juncture of each collapse panel with the front and rear label panels. Preferably, the front label panel is provided with a series of horizontally extending grooves and lands that are intercepted by vertically disposed creases to prevent barreling of the container sidewall. The overall container is characterized by a minimum of structural elements that improve the container's appearance. Certain structural relations desirable to achieve these functions are disclosed.

BRIEF DESCRIPTION OF THE DRAWINGS

The foregoing and other objects, features and advantages of the present invention become apparent from the following description when taken in conjunction with the accompanying drawings, in which.

DETAILED DESCRIPTION OF A PREFERRED EMBODIMENT

Figure 1:
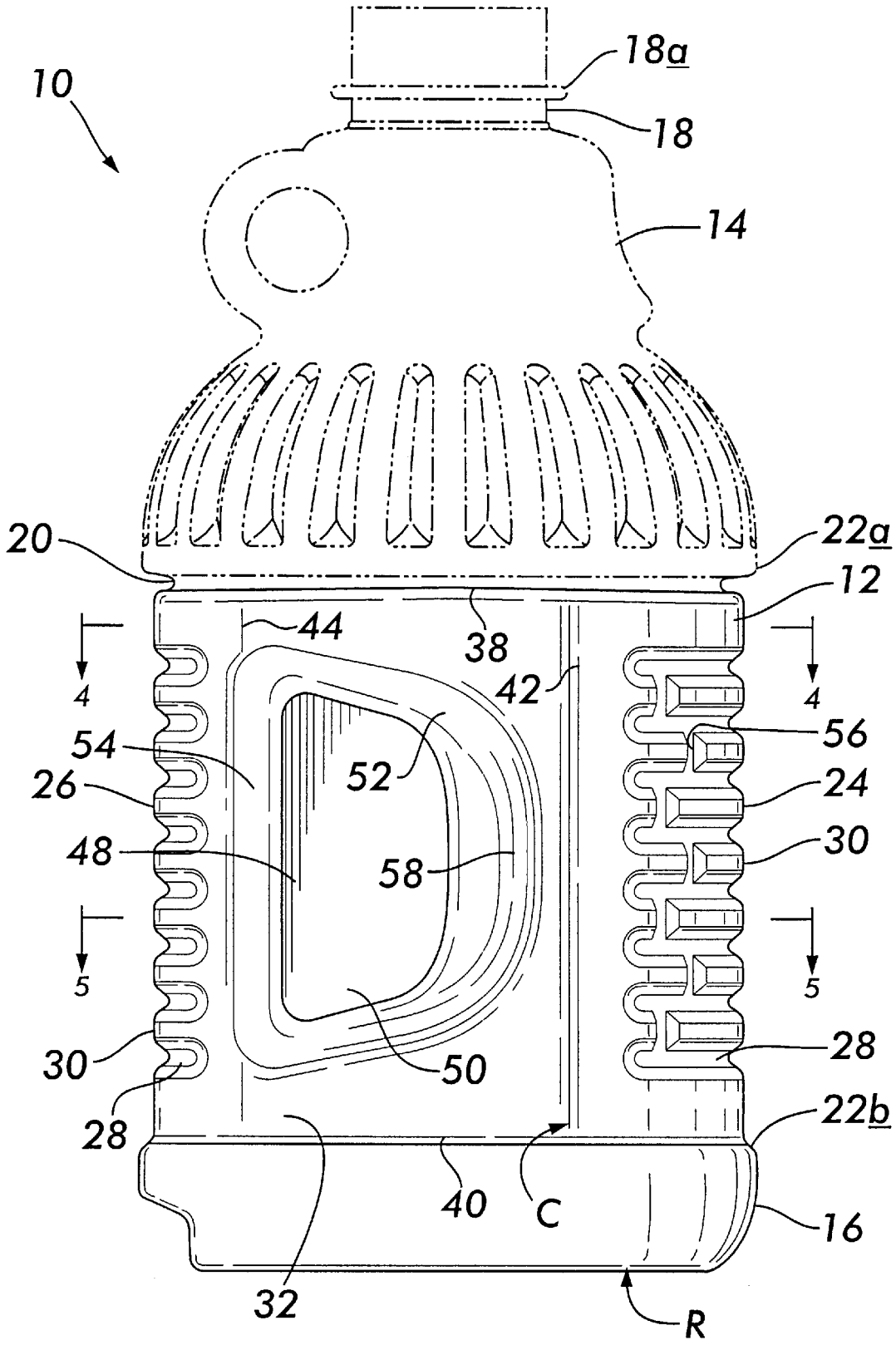
FIG. 1 is a left side elevational view of a container embodying the present invention.

The container 10 of the present invention illustrated in FIGS. 1–5 is particularly suited for hot-fill packaging of beverages, such as juice. The unique construction of the sidewall 12 of the container 10 enables the container to accommodate vacuum-induced volumetric shrinkage caused by hot-filling while affording a consumer-friendly package that is easy to grip with one hand.

Structurally, container 10 has a dome 14 and a base 16 that extend integrally from opposite ends of the sidewall 12.

Preferably, dome 14 has an upstanding finish 18 with a peripheral flange 18*a*. Dome 14 is circular in transverse cross-section adjacent the sidewall 12, and interconnects with sidewall 12 via a peripheral groove 20 that extends inwardly below an upper label bumper 22*a* at the base of the dome 14. Preferably, base 16 is coaxial with the dome 14, is circular in transverse cross-section adjacent the sidewall 12, and interconnects with sidewall 12 via a peripheral lower label bumper 22*b*. While a preferred dome and a preferred base are illustrated in the drawings, other dome and base configurations can be utilized with the novel sidewall 12 of the present invention.

Figure 4:
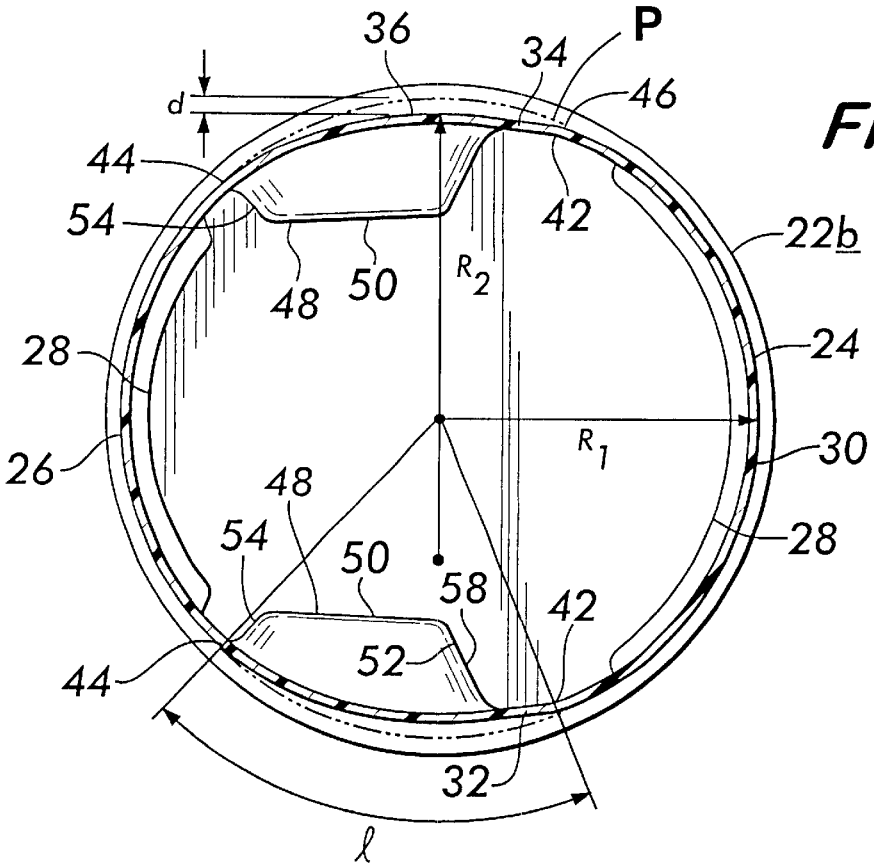
FIG. 4 is a cross-sectional view of the container illustrated in FIG. 1 along the line 4—4.

A unique aspect of the container 10 is that the sidewall 12 comprises different arcuate sections with different radii of curvature. To this end, the sidewall 12 has an arcuate front label panel 24 located opposite an arcuate rear label panel 26. The two label panels are interconnected by a pair of identical, arcuate unframed collapse panels, 32 and 34. These four panels are all generally rectangular and convex. Together the label and collapse panels form a continuous, integral circumferential sidewall 12. The label panels, 24 and 26, and the collapse panels, 32 and 34, have different radii of curvature. Thus, while the sidewall 12 may appear substantially cylindrical, the sidewall 12 is not actually circular in transverse cross-section. Rather, as illustrated in FIG. 4, a cylindrical plane "P" passes only through the label panels 24 and 26, while the collapse panels 32 and 34 are inset from that plane.

The different arcuate sections of the sidewall 12 provide different functions. For instance, in response to hot-filling, the arcuate label panels, 24 and 26, resist deformation, while the arcuate unframed collapse panels, 32 and 34, are believed to move inward to accommodate volumetric shrinkage of the container 10. Additionally, the label panels provide support for labels affixed to the container, while the collapse panels support hand grips.

Figure 2:
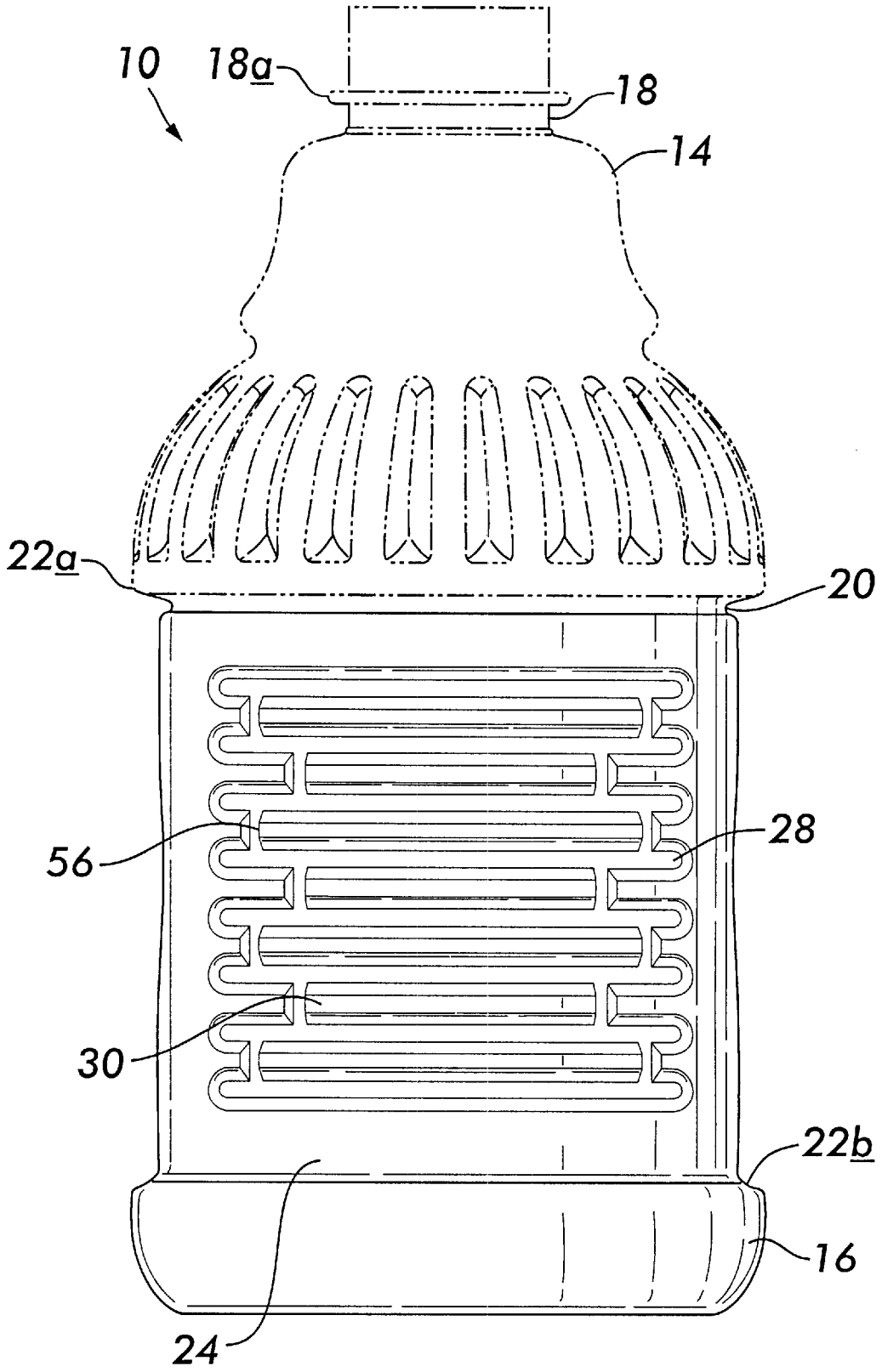
FIG. 2 is a front elevational view of the container illustrated in FIG. 1.
Figure 3:
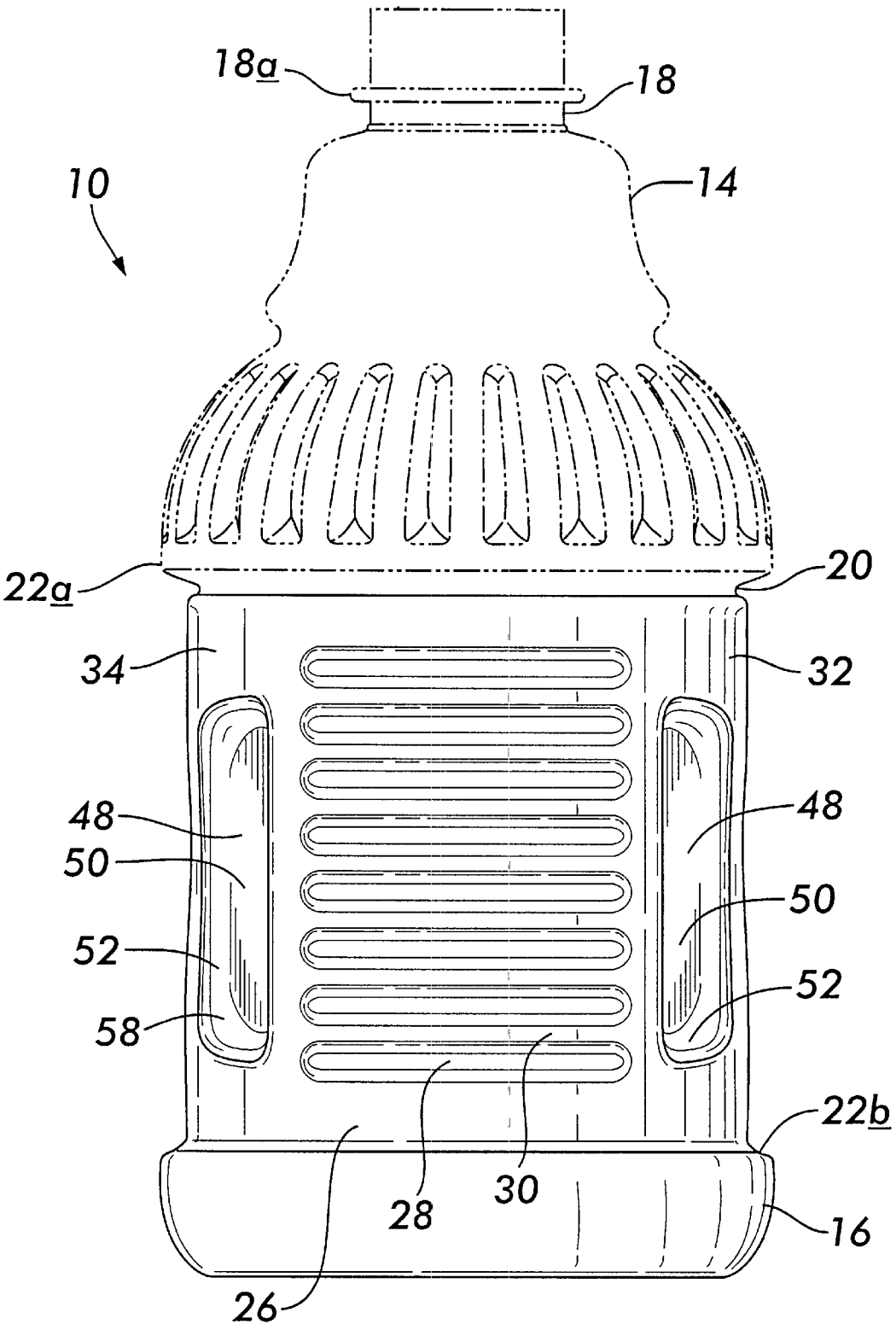
FIG. 3 is a rear elevational view of the container illustrated in FIG. 1.

As illustrated in FIGS. 2 and 3, the label panels, 24 and 26, extend continuously in a longitudinal direction from the groove 20 below the upper label bumper 22*a* to the lower label bumper 22*b*. As illustrated in FIG. 4, each label panel, 24 and 26, has a predetermined radius of curvature $R_1$, throughout its arcuate extent. Preferably, the arcuate extent of the front label panel 24 is greater than the arcuate extent of the rear label panel 26, and the radius of curvature of each is the same. Preferably, both label panels, 24 and 26, have a plurality of vertically-spaced circumferential stiffening ribs 28 separated by horizontally elongate lands 30. The stiffening ribs 28 rigidify the label panels and resist barreling, also known as ovalization.

An inset grip region 48 is formed in each collapse panel, 32 and 34, to afford facile gripping of the container. Each grip 48 is substantially vertically centered on each collapse panel and is horizontally offset rearwardly on each collapse panel so as to be located closer to the rear label panel 26 than to the front label panel 24. Preferably, each grip 48 includes an inset, trapezoidal-shaped, planar wall portion 50 surrounded by an integral rigid frame 52. Frame 52 includes a vertical rear post 54 that extends adjacent the juncture 44 between the rear label panel 26 and the collapse panel to form a part of a rear vertical transitional zone. Frame 52 also includes a tapered inwardly extending wall portion 58 that extends around the frontal, upper and lower portions of planar wall portion 50 to connect it to the rest of the collapse panel 32, thereby causing the frame and grip to have a generally C-shaped configuration.

The arcuate collapse panels, 32 and 34, extend vertically from the groove 20 below the upper label bumper 22*a* to the lower label bumper 22*b*. As illustrated in FIG. 4, collapse panels 32 and 34 have a predetermined radius of curvature $R_2$ throughout their arcuate extents. The radius of curvature $R_2$ of each collapse panel 32 and 34 is greater than the radius of curvature $R_1$, of label panels 24 and 26. Thus in transverse cross-section, sidewall 12 does not have a circular shape due to the differences in the radii of curvature, $R_1$ and $R_2$. This is illustrated by the circular dashed line in FIG. 4 and the distance "d" which represents the distance a vertical medial apogee 36 of the collapse panel 34 is inset from the imaginary cylindrical plane "P" passing through the label panels, 24 and 26.

Sidewall 12 is unique because there is little structure associated with the collapse panels as is common with prior art collapse panel containers. See, e.g., U.S. Pat. Nos. 5,141,120, 5,141,121, 5,392,937, 5,472,105. The vertical margins of each of collapse panels 32 and 34 are indistinct because the radius of curvature of the bottle sidewall transitions gradually from that of the label panel to that of the collapse panel. The junctures between the collapse and label panels and the container dome and base merge at right angles, as illustrated at location "C" where the junctures 42 & 44 meet the junctures 38 & 40, to form a rectangular panel.

Figure 5:
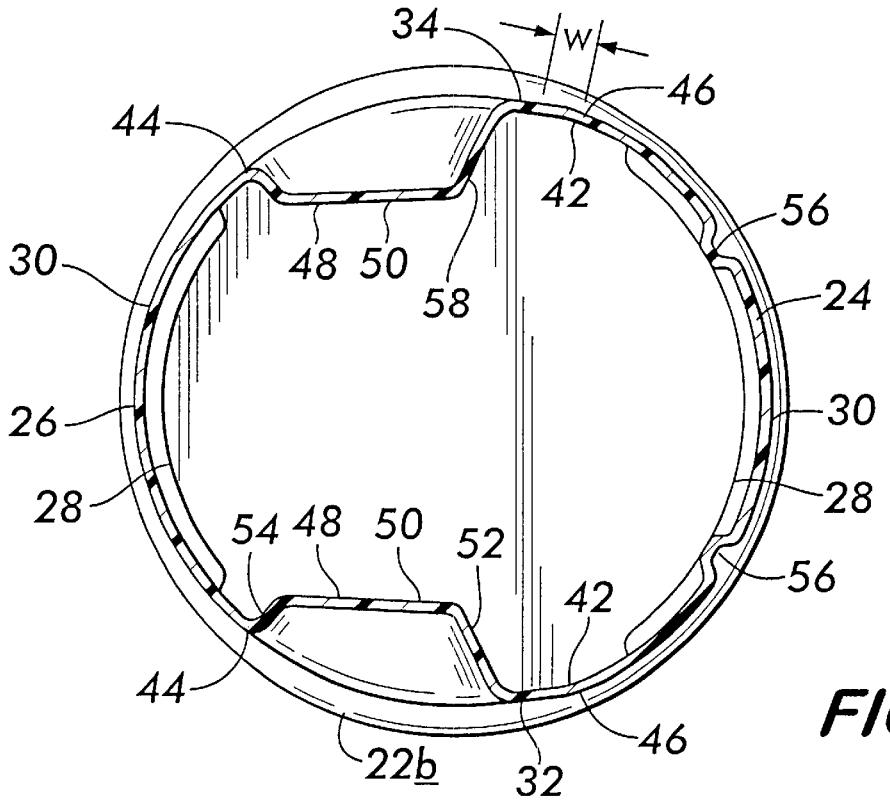
FIG. 5 is a cross-sectional view of the container illustrated in FIG. 1 along the line 5—5.

Zones of transition provide a smooth and continuous change in the radius of curvature of the container wall between the collapse and label panels. As illustrated in FIG. 5, transitional zone 46 has a predetermined arcuate extent "W" located at the juncture 42 of the collapse panel 34 and the front label panel 24. A similar rear transitional zone, of somewhat lesser arcuate extent, is present at the rear label panel juncture 44 above and below the grip post 54.

As formed, collapse panels 32 and 34 are convex and move inwardly toward a somewhat less convex shape in response to vacuum-induced volumetric shrinkage of the hot-filled container. Thus, the collapse panels 32 and 34 accommodate a portion of the volumetric shrinkage without distorting the bottle sidewall by inverting or denting, as in prior art containers. See, e.g. U.S. Pat. Nos. 5,141,121 and 4,877,141.

Figure 6:
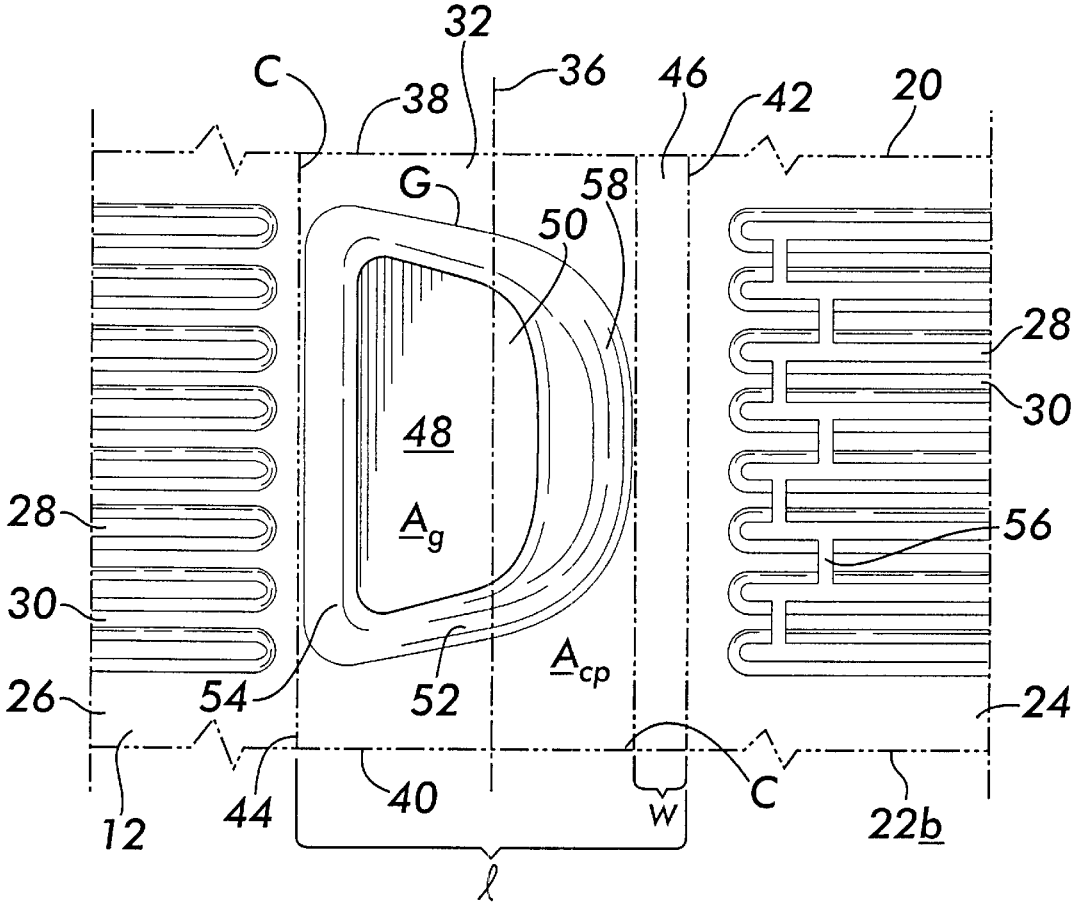
FIG. 6 is a fragmentary, developed view of a 180° section of the sidewall between the middle of the front and rear label panels.

To achieve the most desirable flexing function there are certain parameters that should be considered carefully, and certain ratios that are believed significant with respect to the performance of the container 10. For instance, the grip, defined by the perimeter line "G" in FIG. 6 should occupy a fraction of the area of each collapse panel. Specifically, for a 64 oz. bottle, the grip area in the illustrated container $A(_g)$ is 17.5 $in^2$, or about 66% of the total 27 $in^2$, area of the collapse panels $A(_{cp})$, thereby providing a Grip Ratio (GR) defined as the ratio of the total collapse panel area of the container ($A_{cp}$) divided by the area of the grip ($A_g$) i.e. G.R.=($A_{cp}/A_g$), of about 1.5:1. The Grip Ratio for this embodiment should be in a range of about 1.3:1 to about 1.7:1.

A Collapse Panel Ratio (CPR), defined as the total surface area of the container below a finish flange ($A_{tc}$) divided by the area of the collapse panel ($A_{cp}$), i.e., CPR=($A_{tc}$)/($A_{cp}$). In the illustrated embodiment, $A_{tc}$ is 198.8 $in^2$. Thus, the CPR is about 7.2:1 in the preferred embodiment. It is believed that the Collapse Panel Ratio may vary from about 6:1 to 8:1.

According to the present invention, the optimal collapse panel motion is obtained when the radius of curvature of the collapse panels is about one-third larger than that of the label panels. A Collapse Panel Curvature Ratio (CPCR), defined as the radius of curvature $R_2$ of the collapse panel divided by the radius of curvature $R_1$ of a label panel, i.e., CPCR=$R_2$/

$R_1$, is about 1.4:1 in the preferred embodiment. The collapse panel ratio may range from about 1.25:1 to about 1.5:1.

The arcuate extent of each collapse panel 32 and 34 is also important in accommodating the vacuum following hot filling to avoid distortion of the container. The total collapse panel arcuate extent "C" is the arcuate extent of its radius $R_2$ in radians, including the frontal transitional zone "W". In the preferred embodiment, the parameter "l" is on the order of at least about one radian (i.e., an arc subtended by an included angle of about 57°).

The lateral dimension of the frontal zone of transition 46 is also believed to be important to the performance of the container. In the preferred embodiment, lateral dimension "W" of zone of transition 46 is less than about 0.5 inches in arcuate extent, and is most preferably about 0.32 inches in extent. The frontal zone of transition forms approximately one-eighth of the total peripheral extent of each of the collapse panels, which is 2.61 inches in the illustrated embodiment. Preferably, the collapse panels, 32 and 34, together, form at least about one-third of the total arcuate extent of sidewall 12.

The area of the base is also believed important to the performance of the container. In the 64 oz. container illustrated, the area of the base, inside its standing ring "R" (FIG. 1), is preferably about 14 $in^2$, i.e., the base has a diameter of about 4 inches. The base push-up region, not shown, is of conventional radial-ribbed design, as well known in the art.

Another aspect of the present invention resides in the enhanced barreling resistance of the front label panel 24. To this end, creases 56 that extend vertically across lands 30 between several of the horizontal stiffening ribs 28 on the front label panel 24 are provided. As illustrated in FIG. 2, creases 56 are located adjacent the opposite ends of the lands 30 and are arranged in a staggered pattern such that the creases on every other land 30 are aligned vertically. Alternatively, the creases 56 may all be aligned vertically. The creases 56 and ribs 28 are preferably concave and extend inward to a similar depth, but the creases do not, themselves, form a continuous vertical groove. It has been found that this rib and crease arrangement ensures that the front label panel 24, and the label attached thereto, remains in a desired arcuate shape and does not flex, barrel or otherwise distort to any undesirable extent.

The present invention provides a hot-fillable and grippable blow-molded container which has fewer structural elements, thereby making it more efficient to mold. The container provides a larger processing window to properly accommodate volumetric shrinkage and yet provide an acceptable aesthetic appearance. The container provides a wider front label panel, a grip that provides a better sense of gripability for the consumers, and better labelability.

Various modifications to the container are contemplated. For instance, the shape and location of the inset grip regions can be modified as well as the shapes of the dome and base. The container can be made smaller or larger, and it can be made of PET or like thermoplastic material. In addition, while the groove 20 and lower label bumper **22*b* provide peripheral stiffening structures, stiffening structures other than the horizontal groove 20 and lower label bumper 22*b*** providing an equivalent function at similar locations may be used.

More importantly, it is believed that the dimensions provided for a 64 oz. jug style container will scale. That is, provided that the ratios of all the dimensions, one to another, remain constant, it is believed that larger or smaller containers will behave similarly.

EXAMPLE

By way of example, and not by way of limitation, one embodiment of the invention provides a container 10 with a capacity of sixty-four fluid ounces. The container 10 is illustrated at 80% of full scale in the drawings, The dimensional specifications recited below and illustrated in the drawings apply to the as-formed, empty container condition, i.e., after blow-molding but before hot-filling, and in the absence of any internal or external applied forces.

The radius of curvature $R_1$ of each of the label panels 24 and 26 is about 2.3 inches. The radius of curvature $R_2$ of each of the collapse panels 32 and 34 is about 3.2 inches. Sidewall 12 is approximately 4.5 inches in height. Since the height of each label panel and collapse panel is constant, the area of each is essentially determined by its arcuate extent. Each collapse panel has an arcuate extent "l" as illustrated on FIG. 4 of about 66°, i.e., greater than about 1.0 radian.

The rear label panel 26 comprises about 25% of the arcuate extent of the sidewall 12. The front label panel 24 comprises about 37% of the arcuate extent of the sidewall 12. The collapse panels 32 and 34 combine to comprise about 38% of the arcuate extent of the sidewall 12. Preferably, the collapse panels, 32 and 34, including the grips 48, have a combined surface area of about 27 $in^2$, and the front label panel 24 has a surface area of about 25 $in^2$.

The distance "d" that the medial apogee of collapse panel 34 is inset from the imaginary cylindrical plane "P" through the label panels, 24 and 26, is about 0.12 inch, or about 5% of the radius of curvature $R_1$ of the label panels, 24 and 26. Preferably, the distance "d" is substantially constant throughout the vertical extent of the collapse panel except at the grip 48. The predetermined arcuate extent of the front transitional zone "W" is about one-eighth of the total arcuate extent of the collapse panel.

While the aforementioned dimensional relations have proven to function satisfactorily, it is believed that some modifications may be possible without significantly adversely affecting the desired performance. Thus, the following ranges may be permissible for the stated parameters:

TABLE I

| Parameter | Range |
|---|---|
| $R_1$ | 2.2–2.4 in. |
| $R_2$ | 3.0–3.3 in. |
| l | 1–1.2 radians |
| d | 0.110–0.200 in. |
| W | 0.100–0.500 in. |
| CPR | 6–8:1 |
| GR | 1.3–1.7:1 |
| CPCR | 1.25–1.50:1 |

While a preferred embodiment of a hot-fillable, grippable container has been described, various modifications, alterations, and changes may be made without departing from the spirit and scope of the present invention as defined in the appended claims.

What is claimed is:

1. A hot-fillable grip container, comprising:

a dome having a lower portion with a circular transverse cross-section;

a base having an upper portion with a circular transverse cross-section located below said dome and coaxially therewith;

a sidewall extending between said dome and base portions, said sidewall having diametrically opposed front and rear label panels and opposed collapse panels disposed between said label panels, each collapse panel having an inset grip region affording facile gripping of the container;

each of said label panels having a predetermined transverse radius of curvature throughout its arcuate extent for providing an inwardly concave surface;

each of said collapse panels having throughout its arcuate extent a predetermined radius of curvature greater than either of said label panels for providing an inwardly concave surface;

the lateral extent of each of said collapse panels being defined by a front transitional zone located at the juncture of said front label panel and said collapse panel radii of curvature and by a rear vertical transitional zone, each of said front transitional zones being a smooth arcuate wall section which smoothly transitions and merges said radius of curvature of said collapse panel into said radius of curvature of said front label panel, said radius of curvature of said front label panel being substantially constant between horizontally opposed front transitional zones;

the vertical extent of each of said collapse panels being defined by a continual arcuate upper peripheral stiffener subjacent said dome and a continual lower peripheral stiffener superadjacent said base, such that said collapse panels merge into said stiffeners for providing upper and lower horizontal zones of flexure for said collapse panels;

said collapse panels moving inward adjacent said grip region in response to forces developed in the container in response to hot-filling with a liquid, capping and cooling;

each of said grip regions being offset reanvardly in its collapse panel so as to be located closer to said rear label panel than to said front label panel; and each of said front transitional zones merging into said front label panel to form a wide generally C-shaped, inwardly-concave smooth wall portion extending around a substantial portion of said grip region.

2. A container according to claim 1, wherein each frontal transitional zone has a predetermined arcuate extent which is less than about one-eighth of the total arcuate extent of the collapse panel.

3. A container according to claim 1, wherein each frontal transitional zone has a predetermined arcuate extent of about one-eighth collapse panel radian.

4. A container according to claim 1, wherein each of said collapse panels has a vertical medial apogee inset from an imaginary cylindrical plane extending vertically through both front and rear label panels.

5. A container according to claim 4, wherein said collapse panel vertical medial apogee is inset radially about 5.0 percent of the radius of curvature of said cylindrical plane.

6. A container according to claim 5, wherein the magnitude of inset of said vertical medial apogee is substantially constant throughout its vertical extent and is less than about one-eighth inch.

7. A container according to claim 6, wherein each of said grip regions has a planar wall portion of generally trapezoidal shape with a base extending vertically contiguous with said rear label panel for substantially less than the vertical distance between said upper and lower stiffeners with the remaining vertical distance being provided by said rear transitional zone which is smaller in arcuate extent than said front transitional zone.

8. A container according to claim 1, wherein said upper peripheral stiffener includes a peripheral groove subjacent said dome, and said lower peripheral stiffener includes a lower label bumper superadjacent said base.

9. A container according to claim 1, wherein at least said front label panel has a plurality of vertically-spaced horizontally extending grooves with similarly extending lands therebetween, and wherein selected ones of said lands have vertically-disposed creases to enhance barreling resistance of said label panel.

10. A grippable sidewall for a hot-fill container having a dome above the sidewall and a base below the sidewall, said sidewall having front and rear label panels each of a predetermined radius of curvature and each of a predetermined arcuate extent for providing an inwardly concave surface, said sidewall also having a pair of collapse panels located between said front and rear label panels, each collapse panel having a predetermined radius of curvature and being of a predetermined arcuate extent for providing an inwardly concave surface, each collapse panel having an inset grip region affording facile handling of the container, each of said grip regions being offset reanvardly in its collapse panel so as to be located closer to said rear label panel than to said front label panel, the vertical extent of each of said collapse panels being defined by a continual arcuate upper peripheral stiffener subjacent said dome and a continual lower peripheral stiffener superadjacent said base, the lateral extent of each of said collapse panels being defined by a front transitional zone located at the juncture of said front label panel and said collapse panel radii of curvature and by a rear vertical transitional zone, each of said front transitional zones being a smooth arcuate wall section which smoothly transitions and merges said radius of curvature of said collapse panel into said radius of curvature of said front label panel, said radius of curvature of said front label panel being substantially constant between horizontally opposed front transitional zones, said radius of curvature of each collapse panel being at least about ⅓ larger than said front label panel radius, and said arcuate extent of each collapse panel being at least about ⅙ of the total arcuate extent of said sidewall, whereby the collapse panels readily flex inwardly to accommodate vacuum-induced volumetric shrinkage.

11. A grippable sidewall according to claim 10, wherein each grip has an area that is about ⅔ of the total area of its associated collapse panel.

12. A grippable sidewall according to claim 10, including a front marginal transitional zone located between said grip and said front label panel and being less than about ⅛ of the total arcuate extent of the collapse panel.

13. A grippable sidewall according to claim 10, wherein said container has a predetermined total surface area, and said total collapse panel surface area of both collapse panels constitutes above about ⅛ of said total container surface area.

14. A grippable sidewall according to claim 10, wherein said grip has an area which is in a range of about 60% to about 70% of the total area of its associated collapse panel, said sidewall has a front transitional zone of less than about 0.5 inch and each collapse panel has a total surface area in a range of about 6% to about 7% of the total surface area of the container.

15. A grippable sidewall according to claim 10, wherein said collapse panel radius of curvature is in a range of about 1.25 to about 1.5 times larger than the radius of curvature of said front label panel.

16. A grippable sidewall according to claim 10, wherein each collapse panel has a total arcuate extent of at least about 1.0 radian.

17. A container according to claim 10, wherein said container has a peripheral groove subjacent said dome and a shoulder superadjacent said base, and said sidewall has a front marginal transitional zone extending between said frontal grip edge and said front label panel and merging with the front label panel by a smooth concave wall providing less than about ⅛ of the total arcuate extent of said collapse panel.

18. A grippable sidewall according to clam 10, having a collapse panel ratio (CPR) in a range of about 6:1 to about 8:1.

19. A grippable sidewall according to claim 10, having a grip ratio (GR) in a range of about 1.3:1 to about 1.7:1.

20. A grippable sidewall according to claim 10, having a collapse panel curvature ratio (CPCR) in a range of about 1.25:1 to about 1.5:1.

21. A grippable sidewall according to claim 10, having a collapse panel ratio (CPR) in a range of about 6:1 to about 8:1, a grip ratio (GR) in a range of about 1.3:1 to about 1.7:1, and a collapse panel curvature ratio (CPCR) in a range of about 1.25:1 to about 1.5:1.

22. A grippable sidewall according to claim 10, having an $R_1$, of about 2.3 in., an $R_2$ of about 3.2 in., a "W" of about 0.32 in., an "l" of about 2.6 in., and a height of about 4.5 in.

23. A grippable sidewall for a hot-fill container having a dome above the sidewall and a base below the sidewall, said sidewall having front and rear label panels each of a predetermined radius of curvature and each of a predetermined arcuate extent for providing an inwardly concave surface, said sidewall also having a pair of collapse panels located between said front and rear label panels, each collapse panel having a predetermined radius of curvature and being of a predetermined arcuate extent for providing an inwardly concave surface, each collapse panel having an inset grip region affording facile handling of the container, each of said grip regions being offset rearwardly in its collapse panel so as to be located closer to said rear label panel than to said front label panel, the vertical extent of each of said collapse panels being defined by a continual arcuate upper peripheral stiffener subjacent said dome and a continual lower peripheral stiffener superadjacent said base, the lateral extent of each of said collapse panels being defined by a front transitional zone located at the juncture of said front label panel and said collapse panel radii of curvature and by a rear vertical transitional zone, each of said front transitional zones being a smooth arcuate wall section which smoothly transitions and merges said radius of curvature of said collapse panel into said radius of curvature of said front label panel, said radius of curvature of said front label panel being substantially constant between horizontally opposed front transitional zones, said container having a collapse panel ratio (CPR) in a range of about 6:1 to about 8:1.

24. A grippable container according to claim 23, herein said collapse panel ratio is about 7.15:1.

25. A grippable sidewall for a hot-fill container having a dome above the sidewall and a base below the sidewall, said sidewall having front and rear label panels each of a predetermined radius of curvature and each of a predetermined arcuate extent for providing an inwardly concave surface, said sidewall also having a pair of collapse panels located between said front and rear label panels, each collapse panel having a predetermined radius of curvature and being of a predetermined arcuate extent for providing an inwardly concave surface, each collapse panel having an inset grip region affording facile handling of the container, each of said grip regions being offset rearwardly in its collapse panel so as to be located closer to said rear label panel than to said front label panel, the vertical extent of each of said collapse panels being defined by a continual arcuate upper peripheral stiffener subjacent said dome and a continual lower peripheral stiffener superadjacent said base, the lateral extent of each of said collapse panels being defined by a front transitional zone located at the juncture of said front label panel and said collapse panel radii of curvature and by a rear vertical transitional zone, each of said front transitional zones being a smooth arcuate wall section which smoothly transitions and merges said radius of curvature of said collapse panel into said radius of curvature of said front label panel, said radius of curvature of said front label panel being substantially constant between horizontally opposed, front transitional zones, said container having a grip ratio (GR) in a range of about 1.3:1 to about 1.7:1.

26. A grippable container according to claim 25, wherein said grip ratio is about 1.5:1.

27. A grippable sidewall for a hot-fill container having a dome above the sidewall and a base below the sidewall, said sidewall having front and rear label panels each of a predetermined radius of curvature and each of a predetermined arcuate extent for providing an inwardly concave surface, said sidewall also having a pair of collapse panels located between said front and rear label panels, each collapse panel having a predetermined radius of curvature and being of a predetermined arcuate extent for providing an inwardly concave surface, each collapse panel having an inset grip region affording facile handling of the container, each of said grip regions being offset rearwardly in its collapse panel so as to be located closer to said rear label panel than to said front label panel, the vertical extent of each of said collapse panels being defined by a continual arcuate upper peripheral stiffener subjacent said dome and a continual lower peripheral stiffener superadjacent said base, the lateral extent of each of said collapse panels being defined by a front transitional zone located at the juncture of said front label panel and said collapse panel radii of curvature and by a rear vertical transitional zone, each of said front transitional zones being a smooth arcuate wall section which smoothly transitions and merges said radius of curvature of said collapse panel into said radius of curvature of said front label panel, said radius of curvature of said front label panel being substantially constant between horizontally opposed front transitional zones, said container having a collapse panel curvature ratio (CPCR) in a range of about 1.25:1 to about 1.5:1.

28. A grippable container according to claim 27, wherein said collapse panel curvature ratio is about 1.4:1.

29. A grippable sidewall for a hot-fill container having a dome above the sidewall and a base below the sidewall, said sidewall having front and rear label panels each of a predetermined radius of curvature and each of a predetermined arcuate extent for providing an inwardly concave surface, said sidewall also having a pair of collapse panels located between said front and rear label panels, each collapse panel having a predetermined radius of curvature and being of a predetermined arcuate extent for providing an inwardly concave surface, each collapse panel having an inset grip region affording facile handling of the container, each of said grip regions being offset rearwardly in its collapse panel so as to be located closer to said rear label panel than to said flout label panel, the vertical extent of each of said collapse panels being defined by a continual arcuate upper peripheral stiffener subjacent said dome and a continual lower peripheral stiffener superadjacent said base, the lateral extent of each of said collapse panels being defined by a front transitional zone located at the juncture of said front label panel and said collapse panel radii of curvature and by a rear vertical transitional zone, each of said front transitional zones being a smooth arcuate wall section which smoothly transitions and merges said radius of curvature of said collapse panel into said radius of curvature of said front label panel, said radius of curvature of said front label panel being substantially constant between horizontally opposed front transitional zones, said container having a collapse panel ratio (CPR) in a range of about 6:1 to about 8:1, a grip ratio (GR) in a range of about 1.3:1 to about 1.7:1, and a collapse panel curvature ratio (CPCR) in a range of about 1.25:1 to about 1.5:1.

30. A blow-molded, plastic container having a sidewall with a grip and at least one label panel, said label panel having a plurality of vertically-spaced horizontally extending grooves with similarly extending lands therebetween, and wherein selected ones of said lands have vertically-disposed creases to enhance barreling resistance of said label panel.

31. A container according to claim 30, wherein said creases extend substantially the full depth of the grooves.

32. A container according to claim 30, wherein said creases are aligned vertically with one another.

33. A container according to claim 30, wherein said creases are located in at least medial ones of said lands.

34. A container according to claim 30, wherein said lands and creases are outwardly,concave.

35. A container according to claim 30, wherein said creases are located adjacent the ends of the lands.

* * * * *

UNITED STATES PATENT AND TRADEMARK OFFICE

CERTIFICATE OF CORRECTION

PATENT NO. : 6,375,025 B1
DATED : April 23, 2002
INVENTOR(S) : Mooney

It is certified that error appears in the above-identified patent and that said Letters Patent is hereby corrected as shown below:

Column 5,
Line 6, replace “extent “C” is the” with -- extent “l” is the --.

Column 7,
Line 35, replace “reanvardly” with -- rearwardly --.

Signed and Sealed this

Twenty-first Day of January, 2003

JAMES E. ROGAN
*Director of the United States Patent and Trademark Office*